US008156886B2

(12) United States Patent
Velcic

(10) Patent No.: US 8,156,886 B2
(45) Date of Patent: Apr. 17, 2012

(54) DEVICE, SYSTEM, STRUCTURE, METHOD, COMPUTER PROGRAM PRODUCT AND CONTROL SYSTEM

(75) Inventor: Karlo Velcic, Älvängen (SE)

(73) Assignee: GVA Consultants AB, Gothenburg (SE)

( * ) Notice: Subject to any disclaimer, the term of this patent is extended or adjusted under 35 U.S.C. 154(b) by 515 days.

(21) Appl. No.: 12/339,555

(22) Filed: Dec. 19, 2008

(65) Prior Publication Data

US 2009/0158991 A1 Jun. 25, 2009

Related U.S. Application Data

(60) Provisional application No. 61/015,272, filed on Dec. 20, 2007.

(30) Foreign Application Priority Data

Dec. 20, 2007 (SE) ..... 0702850

(51) Int. Cl.
*B63B 23/28* (2006.01)

(52) U.S. Cl. ..... 114/375; 114/366

(58) Field of Classification Search ..... 114/365, 114/366, 375; 182/10; 405/1, 2, 3, 4, 5
See application file for complete search history.

(56) References Cited

U.S. PATENT DOCUMENTS

| | | | | |
|---|---|---|---|---|
| 185,283 | A | 6/1876 | Bourke | |
| 1,069,905 | A * | 8/1913 | Scott | 114/366 |
| 1,270,903 | A | 7/1918 | Weismantel | |
| 2,351,478 | A * | 6/1944 | Boyle | 114/375 |
| 4,300,854 | A * | 11/1981 | Sluys | 405/1 |
| 4,660,677 | A | 4/1987 | Hunter | |
| 5,184,913 | A * | 2/1993 | Meriwether | 405/1 |
| 5,379,715 | A * | 1/1995 | Skaarup et al. | 114/375 |
| 5,400,733 | A * | 3/1995 | Richter | 405/2 |
| 7,478,608 | B2 * | 1/2009 | Wesley | 114/366 |

FOREIGN PATENT DOCUMENTS

| | | |
|---|---|---|
| DE | 4431542 | 4/1995 |
| RU | 1791273 | 1/1993 |

* cited by examiner

*Primary Examiner* — Lars A Olson
(74) *Attorney, Agent, or Firm* — KBR IP Legal Dept.

(57) ABSTRACT

Device (10) or apparatus for launching at least one boat (12) from a structure (14), that is at least partially surrounded by water (16), into the water. The device (10) comprises at least one launch ramp (18) and means to effect translational displacement of said at least one launch ramp (18) when the device (10) has been mounted on said structure (14) in order to enable the position of said at least one launch ramp (18) to be changed before launching said at least one boat (12) into the water (16).

19 Claims, 5 Drawing Sheets

DEVICE, SYSTEM, STRUCTURE, METHOD, COMPUTER PROGRAM PRODUCT AND CONTROL SYSTEM

CROSS-REFERENCE TO RELATED APPLICATIONS

This application claims benefit of U.S. Provisional Patent Application No. 61/015,272, filed on Dec. 20, 2007, and of Swedish Patent Application 0702850-9 filed on Dec. 20, 2007.

BACKGROUND

1. Field

The present embodiments generally relate devices, systems, methods and control systems for launching at least one boat from a structure that is at least partially surrounded by water. The present embodiments also concerns structures, such as an offshore installation or a sea-going vessel, comprising such a device or system and a computer program product.

2. Description of the Related Art

Many ships and offshore installations, such as oil platforms, are equipped with lifeboats to allow passengers and crew to escape in an emergency. Ship-launched lifeboats were traditionally designed to be lowered from davits on the ship's deck. A davit is a structure, such as a mechanical arm with a winch, which is used to lower lifeboats over the side of a ship.

Nowadays, many ships and offshore installations are provided with freefall lifeboats that are stored on a downward sloping launch ramp. When the lifeboat is released, it slides down the launch ramp and drops into the water. A disadvantage with freefall lifeboats is that if launched, return to the launching system is only possible using means such as a hydraulic lift since such lifeboats are considerably heavier than lifeboats that are designed to be lowered from davits, so as to survive the impact with water. Freefall lifeboats are however used for their capability to launch almost instantly and their high reliability.

Freefall lifeboats are designed to withstand a predetermined drop/launch height, usually in the range of 20-40 fmeters above sea level. A lifeboat that is launched from a launch ramp positioned at an optimum height will be propelled away from the structure on which the lifeboat ramp is mounted. However, if a launch ramp is mounted on a floating offshore structure, such as an oil platform, the height of the launch ramp above sea level may become too high or too low if the structure tilts, due to damage to its hull for example. If the height of the launch ramp above sea level is too high, the lifeboat may be damaged during its launch. If the height above seal level is too low, the lifeboat may be damaged due to impact by waves and it may become difficult to launch the lifeboat.

Offshore installations, such as oil platforms, may be provided with more lifeboats than are necessary for the number of people working on the offshore installation. This is to ensure that there are enough lifeboats for everyone even if some of the lifeboats are rendered unusable/un-reachable (due to a fire in one part of the offshore installation) or un-launchable (due to the offshore installation tilting). Half of an offshore installation's lifeboats may for example be located on one side of the offshore installation and the other half may be located on the opposite side of the offshore installation. Problems may still however arise if all of the offshore installation's lifeboats are unusable/un-reachable or un-launchable.

UK patent application no. GB 2 092 103 discloses an oil platform comprising an extensible support arm that is arranged to swing a lifeboat away from the oil platform. The support arm extends under gravity and a coupling is released to drop the lifeboat into the sea in order to reduce the drop between the life-boat's mooring position and the sea, or to eliminate the drop completely. A disadvantage with such a lifeboat launching system is that it involves high fabrication costs and significant maintenance costs in exchange for a relatively minimal guarantee of functional reliability.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
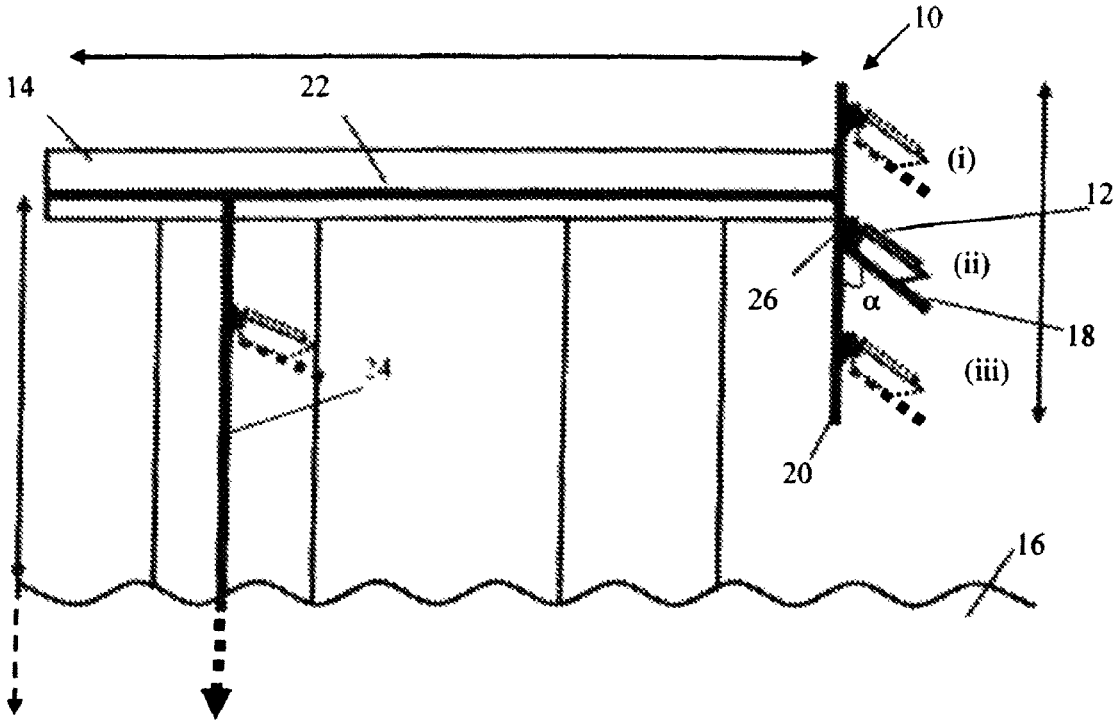
FIG. 1 schematically depicts a device according to a present embodiment of mounted on an offshore structure.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

An object of the present invention is to provide an improved device for launching at least one boat from a structure that is at least partially surrounded by water, into the water.

This object can be achieved by a device that comprises at least one launch ramp, i.e. a sloping plane along which a boat may slide. The boat may be a free-fall boat or a lifeboat, or a free-fall lifeboat or any other sea-going vessel that is suitable for launching from a launch ramp. The device comprises means to effect translational displacement of the at least one launch ramp when the device has been mounted on the structure in order to enable the position of the at least one launch ramp to be changed before launching the at least one boat into the water. Such a device allows the at least one boat to be launched very quickly, i.e. as soon as the boat has been boarded and positioned at a predetermined optimum position for launching. The device also ensures that the at least one boat may be launched in a safe and reliable manner even if the structure on which the at least one boat is mounted tilts or moves vertically upwards or downwards with respect to the water level, or if a particular escape route is blocked, i.e. if there is a fire on one side of the structure on which the at least one boat is mounted.

The expression "translational displacement" as used in this document, is intended to exclude the movement of launch ramps that are pivotably mounted on a structure. In other words the position of a launch ramp in a device according to the present invention is changed by moving the entire launch ramp rectilinearly or non-rectilinearly in order to change the height and/or horizontal position of each part of the launch ramp with respect to the water level rather than just displacing part of a pivotably mounted launch ramp about a pivot point.

According to an embodiment of the invention the at least one launch ramp is arranged to be inclined at a fixed angle to said structure when the device is mounted on said structure. Alternatively the device comprises means to vary the angle at which said least one launch ramp is arranged to be inclined prior to launching said at least one boat into the water. The at least one launch ramp may therefore be pivotably mounted.

According to another embodiment of the invention the device comprises means to effect rectilinear displacement of the at least one launch ramp when the device has been mounted on the structure. For example, the device comprises means to effect vertical displacement of the at least one launch ramp in order to change the height of said at least one launch ramp above the water and/or means to effect horizontal displacement of said at least one launch ramp.

According to an embodiment of the invention the means to effect translational displacement of the at least one launch ramp comprise a hoisting/lowering means, such as a winch, powered manually or by a hydraulic, pneumatic, electric or internal combustion drive. According to an embodiment of the invention the device comprises at least one guide means, such as a frame comprising a guide rail or track. The guide means are arranged to be mounted on the structure, and the at least one launch ramp is slidably mounted on the at least one guide means. Any conventional means may however be used to enable the at least one launch ramp to be displaced translationally.

The device may comprise means to affect horizontal and/or vertical (and/or diagonal) movement in a rectilinear or non-rectilinear path, with respect to the plane of the water surface, for example by mounting the at least one launch ramp on a guide means comprising components that extend both vertically and/or horizontally (and/or diagonally) in a rectilinear or non-rectilinear path. A hydraulic, pneumatic, electric or internal combustion drive may be used to move the at least one launch ramp along the guide means. An electric motor may for example be used to move a launch ramp substantially horizontally, and substantially vertically upwards, and the weight of the launch ramp itself may be used to move the launch ramp substantially vertically downwards under the influence of gravity.

According to another embodiment of the invention the device comprises sensor means, such as an ultrasonic sensor, to determine the height of at least one part of the device, such as part of the ramp, above the water level. The height of two or more parts of the device may be determined to check whether the part of the structure on which the device is mounted is substantially parallel to the surface of the water. The sensor means may be arranged to be located in the, or each boat that is to be launched from a launch ramp, or on any part of the device for launching the at least one boat, or on any part of the structure on which the at least one boat is mounted.

According to a further embodiment of the invention the device comprises a control system that is arranged to receive information concerning the height of the at least one part of the device above the water level and, optionally, change the position of the at least one launch ramp so that the at least one boat may be launched from a height within a predetermined interval above the water level. It should be noted that the optimum height from which a boat should be launched varies depending on the type of boat being used. A boat, such as a lifeboat, may for example be designed to withstand being launched from the deck of a ship or an offshore or on-shore structure, while falling up to 40 m vertically and perhaps up to 30 m horizontally with up to 100 people on board and hitting the water at a speed of approximately 100 kph or more, while keeping its occupants safe. Such a control system may be used to place a boat on, or return a boat to a device according to the present invention.

The control system may, if safety regulations so allow, be arranged to automatically displace the at least one launch ramp to a optimum height within a predetermined interval for launching the at least one boat once a boat has been boarded and a crew member on board the boat, or on the structure on which the device is mounted, has indicated that the crew onboard the boat are ready for the boat to be launched, by actuating a lever for example. The control system may also be arranged to release a boat from a launch ramp once it is at in optimum position for launch. Alternatively, or additionally, the displacement of a launch ramp and the release of a boat therefrom may be controlled from on board the boat by a crew member having access to the control system and preferably having the possibility of overriding the control system. Even if a control system may be used automatically displace a boat to an optimum position for launching a boat, human intervention may namely be necessary to ensure that the boat is not launched into the path of a sea-going vessel or a fire in the vicinity of the structure on which the device is mounted, for example.

According to an embodiment of the invention the device comprises a control system that is arranged to receive information concerning the height of the at least one part of the device above the water level and to change the vertical and/or horizontal position of the at least one launch ramp if/when the height of at least one part of the device above the water is less than or greater than a height within a predetermined interval. This avoids the risk of the at least one boat becoming submerged in the water before it is launched from the at least one launch ramp.

According to an embodiment of the invention the device comprises a plurality of launch ramps. According to another embodiment of the invention comprises means to change the position of each of the plurality of launch ramps independently of the other launch ramp(s) by providing each launch ramp with its own drive means. Alternatively the plurality of launch ramps is arranged to be displaced in parallel.

According to a further embodiment of the invention the device is arranged to launch one boat from each launch ramp.

According to another embodiment of the invention the device is arranged to store at least one boat or a plurality of boats on the at least one launch ramp until said at least one boat is launched into the water.

According to an embodiment of the invention the device comprises means to releasably attach a boat at the top of each launch ramp.

According to another embodiment of the invention the device optionally comprises a control system that is arranged to launch the plurality of boats in a predetermined order and, optionally to change the position of each launch ramp before each of the plurality of boats is launched into the water.

According to a further embodiment of the invention the device is arranged to launch a plurality of boats from a single launch ramp. The device may for example be mounted in the vicinity of a plurality of boats that is arranged to be placed on the ramp, one at a time and launched from the launch ramp. It should be noted that the device according to the present invention may comprise at least one launch ramp that may be used to store and/or launch more than one boat at a time, for example a launch ramp may be designed to store and/or launch a plurality of boats positioned side by side on a launch ramp.

The present invention also concerns a system for launching at least one boat from a structure that is at least partially surrounded by water. The system comprises at least one boat, such as a lifeboat or any other type of boat (i.e. a floating and/or submersible vessel) that is used by people working on, or visiting the structure on which the device is mounted, and a device according to any of the embodiments of the invention.

The present invention further concerns a structure, such as an oil platform (also called oil rig), a gas platform, a drilling platform, seabed mining apparatus, a marine biology laboratory, power plant, a crane platform or sea-going vessel, which comprises a device or system according to any of the embodiments of the invention.

The present invention also concerns a method for launching at least at least one boat from a device mounted on a structure that is at least partially surrounded by water, into the water. The method comprises the steps of: determining the height of at least one part of the device above the water level, and translationally displacing the at least one launch ramp of a device when the device has been mounted on the structure in order to enable the position of the at least one launch ramp to be changed before launching the at least one boat into the water.

The present invention also concerns a method for launching at least at least one boat from a device that is mounted on a structure that is at least partially surrounded by water into the water. The method comprises the steps of: determining the inclination of the at least one launch ramp, and translationally displacing the at least one launch ramp when the device has been mounted on the structure in order to change the inclination of the at least one launch ramp before launching the at least one boat into the water.

The present invention further concerns a computer program product that comprises a computer program containing computer program code means arranged to cause a computer or a processor to execute the steps of such methods, stored on a computer-readable medium or a carrier wave.

The present invention also concerns a control system for controlling the launch of at least one boat from a structure that is at least partially surrounded by water, into the water, which comprises a computer program product according to any of the embodiments of the invention.

According to an embodiment of the invention the control system is arranged to provide users of a boat, whose launch is controlled thereby, with information concerning the height of the boat above the water level and/or instructions on how/when to change the position of the boat before its launch. The control system may for example be arranged to warn the users of a boat that its position should be changed before the boat is launched into the water.

With reference to the figures, FIG. 1 schematically depicts a device according to a present embodiment of mounted on an offshore structure. FIG. 1 shows a device 10 for launching one boat 12, such as a lifeboat or any other kind of floating and/or submersible sea-going vessel, from an offshore structure 14, such as an oil platform, into the water 16. The device 10 comprises a launch ramp 18 that is arranged to be inclined at an angle within a predetermined interval to the structure 14 when the device 10 is mounted on the structure 14. The device 10 comprises means (not shown) to effect translational displacement of the launch ramp 18, which translational displacement is illustrated as a rectilinear displacement in FIG. 1, when the device 10 has been mounted on the structure 14 in order to enable the position of the launch ramp 18 to be changed before launching the boat 12 into the water 16.

In the illustrated embodiment the launch ramp 18 may be moved vertically along a first guide rail or track 20, horizontally along a second guide rail or track 22 and vertically along a third guide rail or track 24. A device 10 may of course be arranged to enable a boat 12 to displaced rectilinearly in any direction. The third guide rail or track 24 extends all the way down to the water level (and optionally below the water level), which allows boats 12 to be launched at or below the water level. Such a guide rail or track 24 extending into the water 16 even allows boats 12 to be easily delivered or returned to the offshore structure 14. Such a device 10 may also be used to transport equipment or any type of cargo to and from the offshore structure 14 The device 10 should, in such a case, be arranged to transport cargo and/or deliver/return boats 12 to launch ramps 18 along paths that would not obstruct the launch of lifeboats from the offshore structure 14 in case of an emergency.

The boat 12 shown in FIG. 1 is located in its normal launch position (ii), ready for the crew of the offshore structure 14 to board the boat 12. Once the crew have boarded the boat 12 while the launch ramp 18 is positioned at the initial position (i), the launch ramp 18 may be lowered to its normal launch position (ii) on the first guide rail or track 20 and launched once releasable attachment means 26 holding the stern of the boat 12 at the top of the launch ramp 18 have been released. It should be noted that the releasable attachment means 26 may be arranged at the front, back, side, bottom and/or top of the boat 12. The boat 12 in the illustrated embodiment is arranged to be boarded when the launch ramp 18 is in the initial position (i), which in FIG. 1 is the highest position (i) on the first guide rail or track 20. This allows the launch ramp 18 to then be lowered under the influence of gravity alone. Optionally, the boat 12 is also boarded while it is located at the desired launch position (ii). The launch ramp 18 may even be raised to a higher position on the first guide rail or track 20 for boarding and/or launch. It should be noted that a device 10 may be arranged to allow a boat 12 to be boarded and/or launched from any number of positions.

Figure 2:
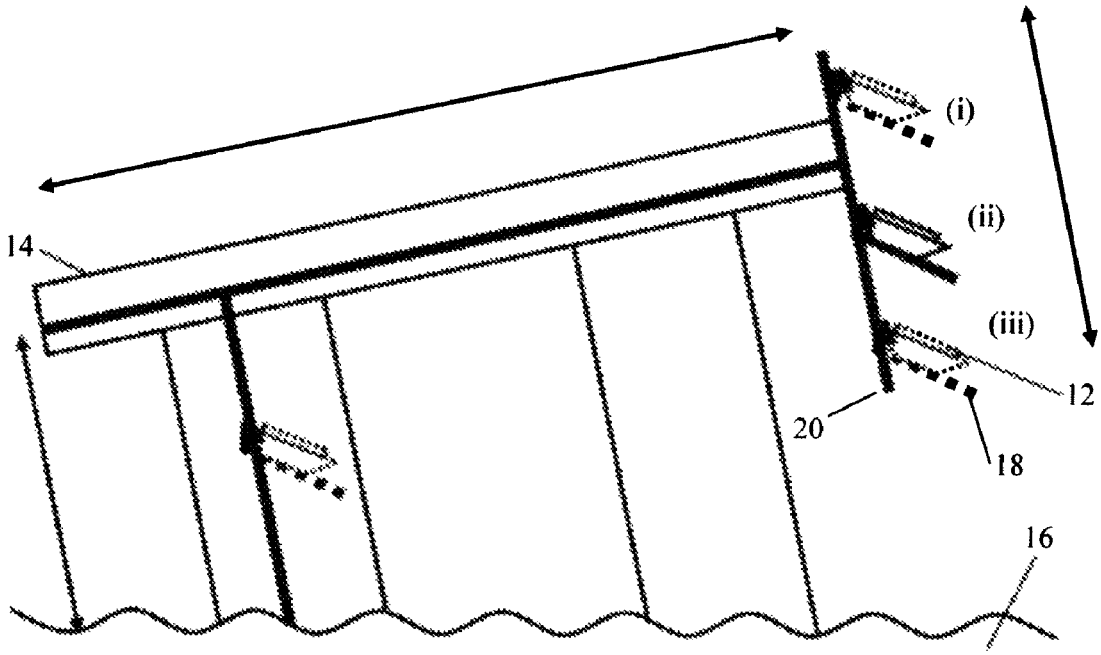
FIG. 2 schematically depicts a device according to a present embodiment of mounted on an offshore structure.

FIG. 2 schematically depicts a device according to a present embodiment of mounted on an offshore structure. FIG. 2 shows the offshore structure 14 depicted in FIG. 1 in a tilted position. If/when the offshore structure 14 is tilted, the launch ramp 18 may be displaced rectilinearly along the first guide rail or track 20 and/or optionally along the second guide rail or track 22 and optionally along third guide rail or track 24 prior to launching the boat 12. FIG. 2 shows the launch ramp 18 in an optimal position (iii) for launch from the first guide rail or track 20.

Figure 3:
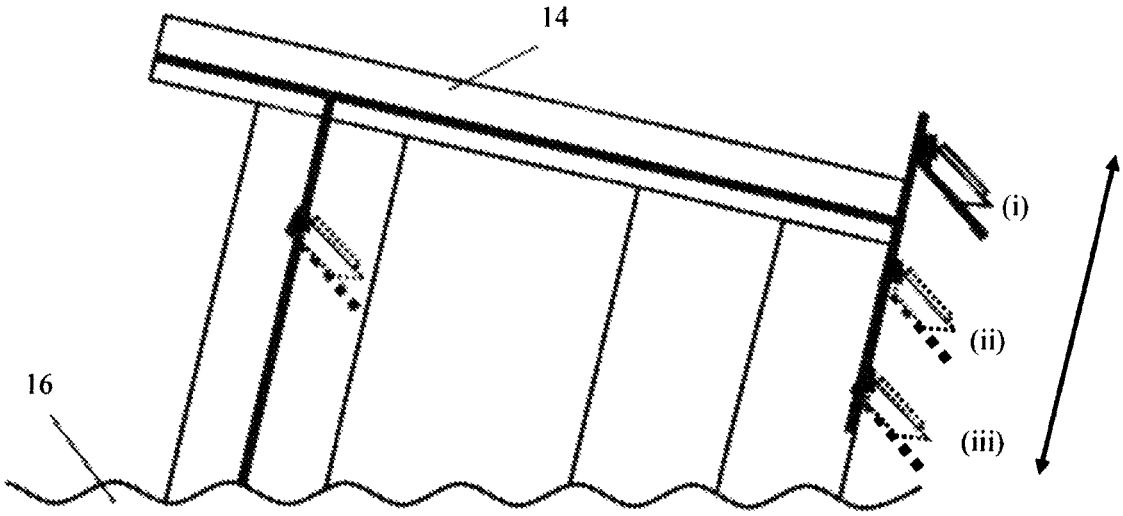
FIG. 3 schematically depicts a device according to a present embodiment of mounted on an offshore structure.

FIG. 3 schematically depicts a device according to a present embodiment of mounted on an offshore structure. FIG. 3 shows the offshore structure 14 depicted in FIG. 1 when the structure is tilted in a direction opposite to the direction shown in FIG. 2. When the structure 14 is in such a position, the boat's optimum launch position (i) will be higher than the optimum launch position (ii) shown in FIG. 2.

Figure 4:
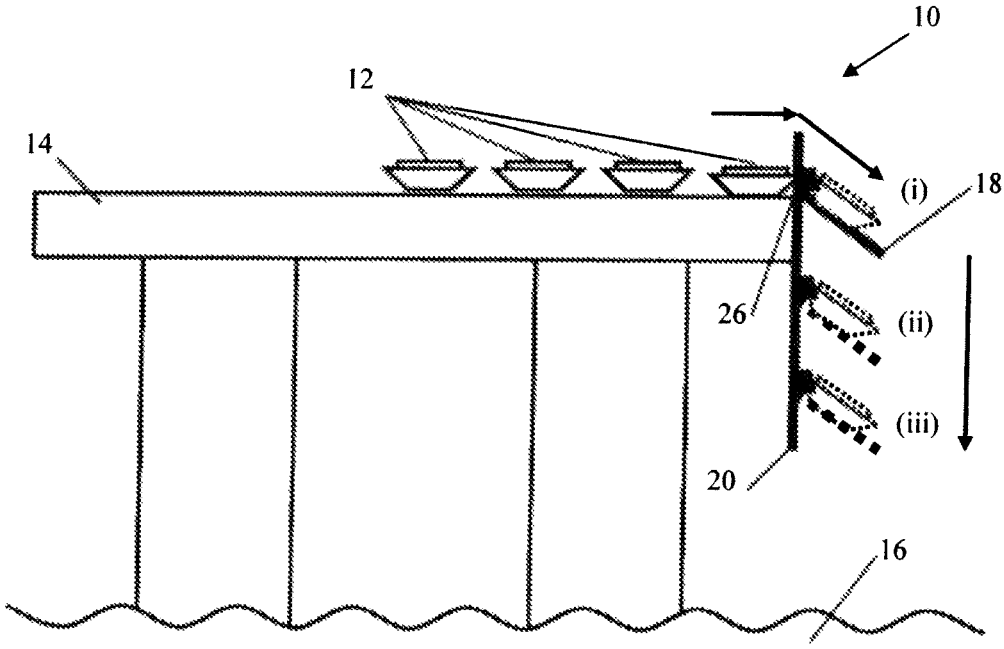
FIG. 4 schematically depicts a device according to a present embodiment of mounted on an offshore structure.

FIG. 4 schematically depicts a device according to a present embodiment of mounted on an offshore structure. FIG. 4 shows a device 10 according to an embodiment of the invention, which is mounted on an offshore structure 14 in the vicinity of a plurality of boats 12, i.e. the boats 12 are not stored on the launch ramps 18 of a device 10. The boat 12 is placed on a launch ramp 18, for example by sliding the boat 12 from a storage ramp onto the launch ramp 18, which may then be displaced vertically downwards along guide rail or track 20 until it reaches an optimum launching position. The releasable attachment means 26 may then be released in order to launch the boat into the water 16. In the illustrated embodiment, a manually-operable winch (not shown) may be used to pull a launch ramp 18 up to a position (i) at the top of the guide rail or track 20. A boat 12 may then be allowed to move down the guide rail or track 20 in a controlled manner under the influence of gravity (using brake means to retard the movement of the boat 12 for example).

A device 10 according to an embodiment of the invention may comprise a plurality of launch ramps 18 on which a plurality of boats 12 are stored, one on each launch ramp 18, until they are launched into the water 16. The launch ramps 18 may be arranged to be moved independently of one another along the guide rail or track 20 or in parallel. Alternatively, or additionally the guide rail or track 20 and the launch ramps 18 may be arranged to be moved in parallel along the side of the offshore structure 14. It should be noted that each of the plurality of ramps need not necessarily be inclined at the same angle. The optimum angle at which each launch ramp 18 is inclined depends on the type(s) of boat being launched from the device 10 and may be in the range of 30-60°. It should be noted that the angle is given as the angle between the top of the ramp and a vertical axis that extends perpendicularly to the water level. If the structure 14 were to tilt, the angle can be adjusted to ensure that a boat 12 would be launched from an optimal angle.

Figure 5:
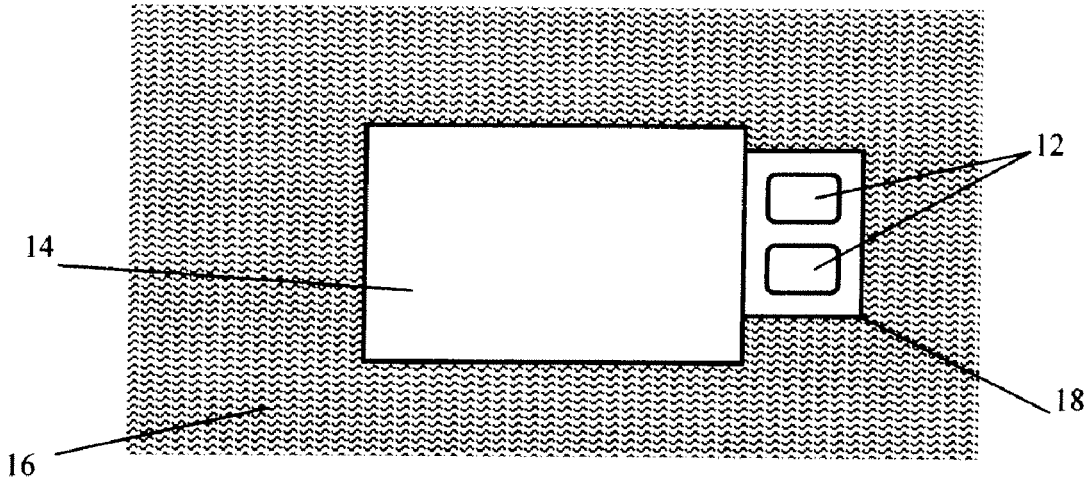
FIG. 5 schematically depicts a device according to a present embodiment of mounted on an offshore structure.

FIG. 5 schematically depicts a device according to a present embodiment of mounted on an offshore structure. FIG. 5 shows a structure 14, such as an oil platform, on which a device (not shown) comprising a launch ramp 18 has been mounted. The launch ramp 18 is arranged to (optionally store and) launch two boats 12, that are located side by side on the launch ramp 18 in a direction parallel to the plane of the water surface.

Figure 6:
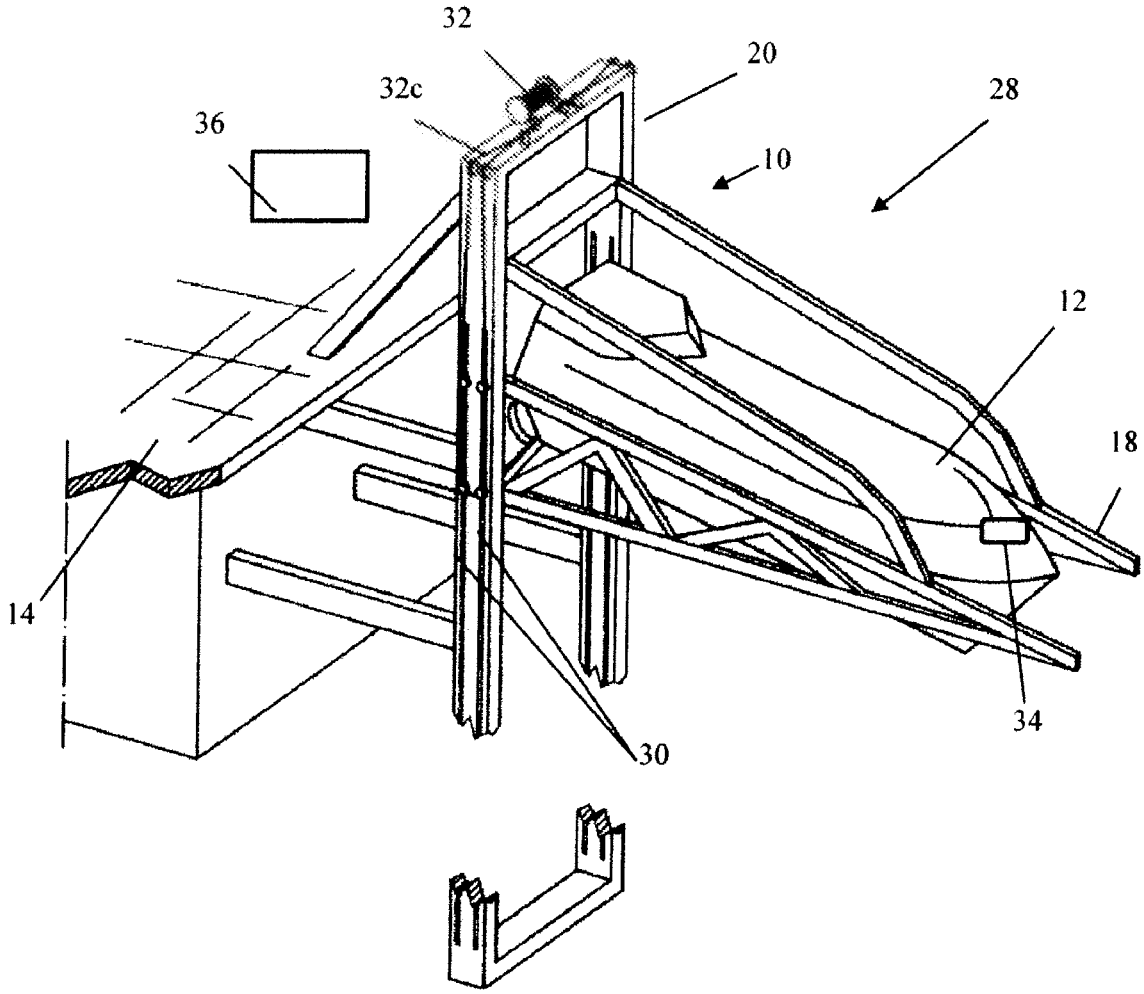
FIG. 6 depicts a system according to a present embodiment.

FIG. 6 depicts a system according to a present embodiment. FIG. 6 shows a system 28 according to an embodiment of the invention which comprises a boat 12, and a device 10 according to an embodiment of the invention. The device 10 may, for example, be mounted on structure 14 such as an oil platform or a ship or a power plant that generates electricity from wind energy, solar energy, underwater currents or tidal power. The device comprises a guide means, namely a frame 20 comprising tracks 30 in which a launch ramp 18 is slidably mounted. The launch ramp 18 may also be pivotably mounted on the frame 20 to enable its inclination to be varied.

The dimensions of the frame 20 vary depending on the size of the structure 14 to which the device 10 is attached and on the number and size of the boats 12 being launched from the device 10. For example, if the frame 20 is used to launch one boat 12, it may be 15-50 meters long and arranged to launch a boat 12 from a height of 15-35 meters above the water level.

The launch ramp 18 is arranged to be displaced vertically along the tracks 30 by means of a winch 32, a hydraulic cylinder or any other conventional lifting means. A winch 32 may be used to wind up a cable 32*c* and may comprise a gear assembly (not shown) powered by a manual, hydraulic, pneumatic, electric or internal combustion drive (not shown). The winch 32 may also comprise a solenoid and/or mechanical brake or ratchet that prevents it from unwinding. The system 28 may optionally comprise a sensor 34 to determine the height of at least one part of the system 28 and/or device 10 above the water level. In the illustrated embodiment the sensor 34 is arranged in the boat 12. The sensor may however be located anywhere on the device 10 or the structure 14 on which the device is mounted.

The system 28 may also comprise means to measure the angle at which the launch ramp 18 is inclined with respect to an axis extending perpendicularly to the water surface, or any other angle indicative if the inclination of the launch ramp 18. A control system 36 may therefore be arranged to receive information concerning the height of boat 12 above the water level and the inclination of the launch ramp 18 and to change the vertical position and inclination of the launch ramp 18 so that the boat 12 may be launched from a height within a predetermined interval above the water level and at an inclination within a predetermined interval. The control system 36 is also arranged to receive information concerning the height of the at least one part of the system 28, such as the tip of the launch ramp, or the bottom of the boat 12, above the water level and to change the vertical position of the launch ramp 18 if/when the height of the at least one part of the system 28 above the water is less than a height within a predetermined interval to avoid the risk of the at least one boat becoming submerged in the water before it is launched from the at least one launch ramp.

Even though some features of the device and/or system according to the present invention have only been described with reference to one embodiment of the invention, any of the features of the invention may be used with any of the embodiments of the invention, unless otherwise specified. Further modifications of the invention within the scope of the claims would be apparent to a skilled person.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, the term should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An apparatus for launching at least one free-fall boat into water from a structure that is at least partially surrounded by water, wherein the apparatus comprises at least one launch ramp and means to effect translational displacement of said at least one launch ramp when the apparatus has been mounted on said structure in order to enable the position of said at least one launch ramp to be changed before launching said at least one boat into the water, further comprising a sensor means to determine a height of at least one part of the apparatus above a water level, an angle that is indicative of inclination of said at least one launch ramp, or combination thereof, and further comprising means to effect rectilinear displacement of said at least one launch ramp when the a appraratus has been mounted on said structure.

2. The apparatus of claim 1, wherein said at least one launch ramp is arranged to be inclined at an angle to said structure when the apparatus is mounted on said structure.

3. The apparatus of claim 2, further comprising means to vary the angle at which said least one launch ramp is arranged to be inclined.

4. The apparatus of claim 1, further comprising means to effect vertical displacement of said at least one launch ramp in order to change height of said at least one launch ramp above the water.

5. The apparatus of claim 1, further comprising means to effect horizontal displacement of said at least one launch ramp.

6. The apparatus of claim 1, further comprising at least one guide means, wherein said guide means are arranged to be mounted on said structure, and that said at least one launch ramp is slidably mounted on said at least one guide means.

7. The apparatus of claim 1, wherein said means to effect translational displacement of said at least one launch ramp comprises a hoisting/lowering means powered manually, hydraulically, pneumatically, electrically or by internal combustion drive.

8. The apparatus of claim 1, further comprising control means that are arranged to receive information concerning the height of said at least one part of the apparatus above the water level and change position of said at least one launch ramp so that said at least one boat may be launched from a second height within a predetermined interval above the water level.

9. The apparatus of claim 1, further comprising control means that are arranged to receive information concerning the height of said at least one part of the apparatus above the water level and to change position of said at least one launch ramp if/when the height of at least one part of the apparatus above the water is less than /greater than a second height within a predetermined interval.

10. The apparatus of claim 1, further comprising positioning means to enable the position of said at least one launch ramp to be changed from inside said at least one boat that is to be launched from said at least one launch ramp.

11. The apparatus of claim 1, further comprising a plurality of launch ramps.

12. The apparatus of claim 11, further comprising positioning means to change position of each of said plurality of launch ramps independently of the other launch ramp(s).

13. The apparatus of claim 11, wherein said plurality of launch ramps are arranged to be displaced in parallel.

14. The apparatus of claim 11, wherein said plurality of launch ramps are arranged to launch one boat from each launch ramp.

15. The apparatus of claim 14, further comprising means to releasably attach one boat at the top of each launch ramp.

16. The apparatus of claim 14, further comprising a control system arranged to launch said plurality of boats in a predetermined order and to change the vertical and/or horizontal position of each launch ramp before each of said plurality of boats is launched into the water.

17. An apparatus for launching at least one free-fall boat into the water from a structure that is at least partially surrounded by water wherein the apparatus comprises at least one launch ramp and means to effect translational displacement of said at least one launch ramp when the apparatus has been mounted on said structure in order to enable the position of said at least one launch ramp to be changed before launching said at least one boat into the water, and further comprising at least one guide means, which is arranged to be mounted on said structure, wherein said ramp is inclined at a fixed angle to the guide means and is slidably mounted on said at least one guide means in order to thereby achieve said translational displacement.

18. An apparatus for launching at least one free-fall boat into water from a structure that is at least partially surrounded by water, wherein the apparatus comprises at least one launch ramp and means to effect translational displacement of said at least one launch ramp when the apparatus has been mounted on said structure in order to enable the position of said at least one launch ramp to be changed before launching said at least one boat into the water, further comprising a sensor means to determine a height of at least one part of the apparatus above a water level, an angle that is indicative of inclination of said at least one launch ramp, or combination thereof, and further comprising at least one guide means, wherein said guide means are arranged to be mounted on said structure, and that said at least one launch ramp is slidably mounted on said at least one guide means.

19. An apparatus for launching at least one free-fall boat into water from a structure that is at least partially surrounded by water, wherein the apparatus comprises at least one launch ramp and means to effect translational displacement of said at least one launch ramp when the apparatus has been mounted on said structure in order to enable the position of said at least one launch ramp to be changed before launching said at least one boat into the water, further comprising a sensor means to determine a height of at least one part of the apparatus above a water level, an angle that is indicative of inclination of said at least one launch ramp, or combination thereof, and further comprising positioning means to enable the position of said at least one launch ramp to be changed from inside said at least one boat that is to be launched from said at least one launch ramp.

* * * * *